US009258645B2

(12) United States Patent
Percy et al.

(10) Patent No.: US 9,258,645 B2
(45) Date of Patent: Feb. 9, 2016

(54) ADAPTIVE PHASE DISCOVERY

(71) Applicant: QNX Software Systems Limited, Kanata (CA)

(72) Inventors: Michael Andrew Percy, Vancouver (CA); Phillip Alan Hetherington, Port Moody (CA)

(73) Assignee: 2236008 Ontario Inc., Waterloo, Ontario (CA)

( * ) Notice: Subject to any disclaimer, the term of this patent is extended or adjusted under 35 U.S.C. 154(b) by 462 days.

(21) Appl. No.: 13/722,341

(22) Filed: Dec. 20, 2012

(65) Prior Publication Data

US 2014/0177869 A1 Jun. 26, 2014

(51) Int. Cl.

| | |
|---|---|
| ***H04R 1/40*** | (2006.01) |
| ***H04R 3/00*** | (2006.01) |
| ***G10L 25/03*** | (2013.01) |
| *G10L 21/0216* | (2013.01) |

(52) U.S. Cl.

CPC ..... *H04R 3/005* (2013.01); *G10L 25/03* (2013.01); *G10L 2021/02166* (2013.01); *H04R 2430/03* (2013.01)

(58) Field of Classification Search

CPC .. H04R 3/005; H04R 2430/20; H04R 1/1083; H04R 1/406; H04R 2420/07; H04R 2430/01; H04R 2410/01; H04R 25/554; H04R 29/006; H04R 3/00; H04R 3/04; H04R 1/227; H04R 1/24; G10K 2210/1282; G10L 21/0208; H04S 1/002

USPC ..... 381/71.4, 89, 97, 94.3, 98, 402; 704/226

See application file for complete search history.

(56) References Cited

U.S. PATENT DOCUMENTS

| | | | | |
|---|---|---|---|---|
| 5,539,859 | A * | 7/1996 | Robbe | G01S 3/808 704/226 |
| 2001/0031053 | A1* | 10/2001 | Feng | H04R 25/407 381/92 |
| 2004/0120535 | A1* | 6/2004 | Woods | H04R 3/007 381/96 |
| 2008/0181058 | A1* | 7/2008 | Hayakawa | 367/125 |
| 2009/0116661 | A1* | 5/2009 | Hetherington | G10K 11/16 381/93 |
| 2010/0110834 | A1* | 5/2010 | Kim et al. | 367/124 |
| 2010/0235171 | A1* | 9/2010 | Takagi | G10L 19/008 704/500 |

(Continued)

OTHER PUBLICATIONS

Office Action issued in related Canadian Patent Application No. 2,799,890, dated Jun. 13, 2014, pp. 1-3.

*Primary Examiner* — Akelaw Teshale
(74) *Attorney, Agent, or Firm* — Brinks Gilson & Lione

(57) ABSTRACT

In an adaptive phase discovery system a first audio signal is received via a first microphone and a second signal is received via a second microphone. Corresponding audio frames of the first and second signals are each transformed into the frequency domain and a plurality of frequency sub-bands are generated. A phase is determined for each frequency sub-band in each signal. Instantaneous phase differences are determined between the signals at each of the frequency sub-bands. Lower frequency instantaneous phase differences are filtered over time to determine current phase differences at lower frequencies. When SNR is high in lower frequency sub-bands, lower frequency sub-band phase differences are tracked to the higher frequency sub-bands. The tracked higher frequency phase differences are filtered over time to determine phase differences for the current frame. The phase differences may be used to rotate phases in each sub-band and sum signals and/or to reject off-axis signals.

25 Claims, 5 Drawing Sheets

(56) References Cited

U.S. PATENT DOCUMENTS

2011/0206223 A1 8/2011 Ojala
2012/0179458 A1* 7/2012 Oh et al. ..... 704/203
2013/0016854 A1* 1/2013 Zheng ..... H04R 3/005 381/94.7
2013/0030801 A1 1/2013 Fallat et al.
2013/0315403 A1* 11/2013 Samuelsson ..... H04R 3/005 381/56

* cited by examiner

ADAPTIVE PHASE DISCOVERY

TECHNICAL FIELD

This application relates to processing signals in an audio environment and, more particularly, to adaptive phase discovery of audio signals.

RELATED ART

Automobiles increasingly incorporate electronic devices into the automobile cabin. These electronic devices may include, for example, mobile phones and other communication devices, navigation systems, control systems, and/or audio/video systems. Users may interact with these devices using voice which may allow a driver to focus on driving the automobile. In some systems, voice commands may enable interaction and control of electronics or a user may communicate hands free in an automobile cabin. Audio signals may be processed in order to identify or enhance desired voice commands.

Speech signals may be adversely impacted by acoustical and/or electrical characteristics of their environment, for example, audio and/or electrical paths associated with the speech signal. For a hands-free phone system or a voice recognition system used to translate audio into a voice command in an automobile or in another physical environment, the acoustics or microphone characteristics may have a significant detrimental impact on the sound quality of a speech signal.

BRIEF DESCRIPTION OF THE DRAWINGS

The system may be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
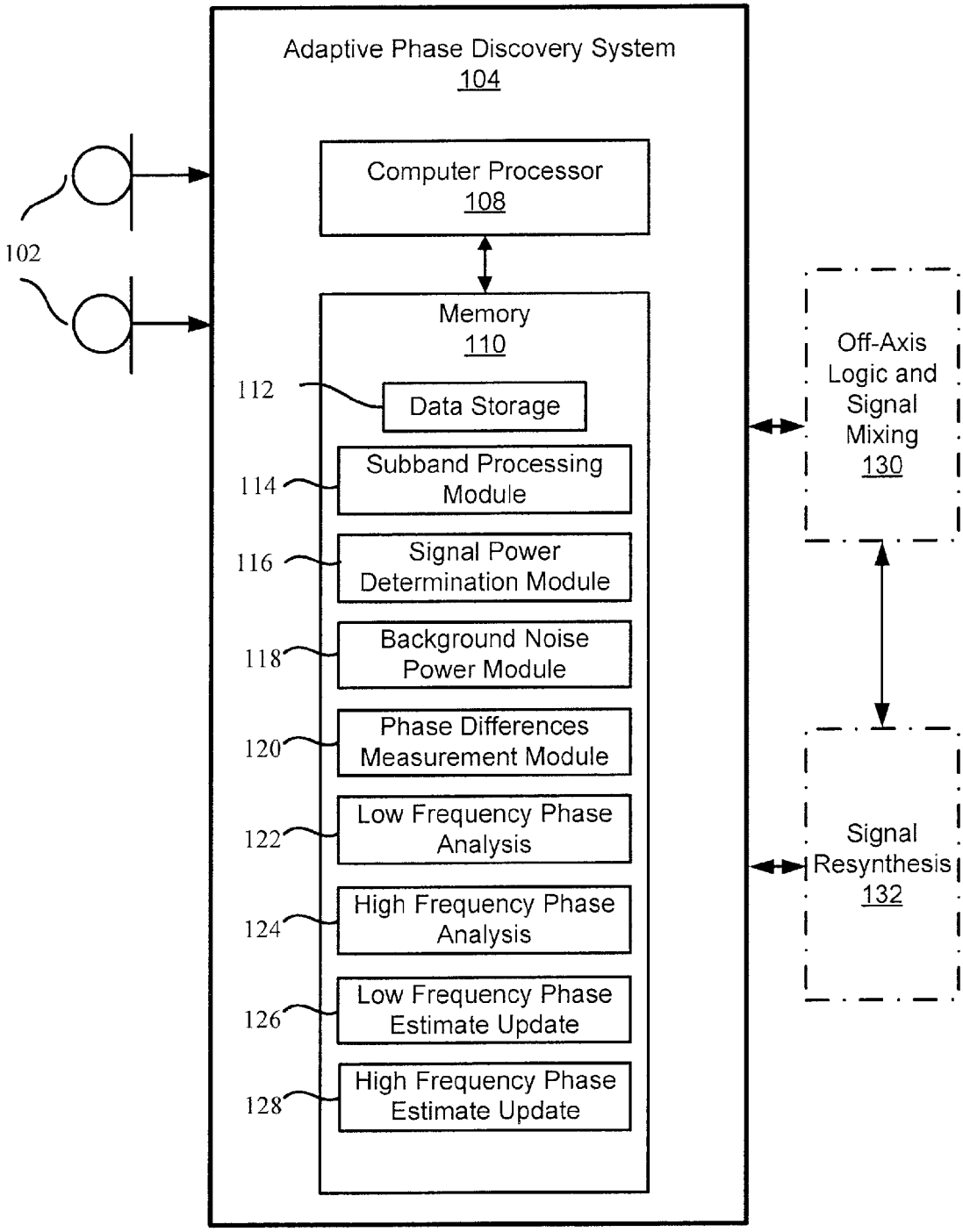
FIG. 1 illustrates an adaptive phase discovery system.

An adaptive phase discovery system is disclosed that may enable estimation of phase differences between two or more audio signals across a broad range of frequencies of the audio signals. The phase differences may be determined for a sound source which may be detected at two or more microphones in a complex acoustic environment. The two or more microphones may be positioned at equal or varying distances between neighboring microphones. In some applications, the two or more microphones may be located relative to a person in a particular environment and may receive voice signals. A sound source may be located relative to the microphones such that a first path length from the source to a first microphone is different or is the same as a second path length from the sound source to a second microphone. Phase differences caused by the different path lengths may be estimated for higher frequencies based on measured phase differences across the whole frequency spectrum resulting in improved phase estimation. This improved estimation of phase differences may enable more accurate mixing of the two or more audio signals and better signal to noise ratios. Moreover, in some systems the improved phase estimation may better enable off-axis audio suppression in voice processing systems.

An adaptive process may be utilized to "learn" phase differences that are produced by sound traveling via two or more paths and received as audio signals at two or more detectors or microphones. Instantaneous phase differences may be determined for corresponding frequency bands of the two or more audio signals. Low frequency phase difference estimates of the two or more audio signals may be filtered or adapted over time. High frequency phase difference estimates may be filtered or adapted over frequency and time where the high frequency phase differences may be correlated to strong signal content found in the low frequencies and/or in the high frequencies. The low and/or high frequency phase difference information may be utilized in many suitable applications. For example, low audio frequencies may have dependable measured phase differences, therefore the signals may be phase shifted and summed together to create a combined signal with improved signal to noise ratio (SNR). At higher frequencies, phase difference measurements may not be predictable (for example due to environmental factors such as reflected paths and/or constructive interference). Therefore, relative phase differences at high frequencies may be estimated based on phase difference information for the whole spectrum.

In a complex physical environment, wave properties of diffraction at low frequencies may enable estimation of phase differences between two signals at lower frequencies, even where the direct acoustic path is obstructed and where effects of reflection may dominate at the higher frequencies. This estimation may be performed when a sound source is detected in received signal content. Initially, instantaneous phase differences between two audio signals may be determined at a plurality of frequency sub-bands across the audio spectrum. The sub-bands may be referred to as frequency bins or frequency ranges. For example, a Fast Fourier Transform (FFT) of each input signal may yield a set of magnitude and phase components for each signal at each discrete frequency bin. The phase differences between two signals, at corresponding frequency bins may be determined by subtracting one set of phase values from the other. Signal to noise ratios may also be determined across the audio frequency spectrum to determine when an audio signal is present at one or more frequency ranges in one or more of the received signals. In instances when signal to noise ratios indicate that a signal from the audio source is present at lower frequencies, the current instantaneous phase differences at higher frequencies can be assumed to be an estimate of the phase differences to be expected from the sound source. The slope of a plot of phase differences at low frequencies may indicate the path length difference of two audio signals from the source, and hence may infer information regarding the location of the sound source relative to the array of microphones. This information can be used to determine whether an observed signal is a "desired" signal and hence whether to use the high-frequency phase differences as an estimate of the phase differences that will be observed from this source. This process may be repeated at subsequent audio frames and phase differences may be adapted over time at each frequency to improve the estimate. The object of this system is to produce good estimates of the phase differences that will be measured when sound from a desired source is detected at the microphones. The improved phase difference estimates may be utilized, for example, to rotate signal phase at each frequency bin to enable a more accurate mixing of the two or more audio signals, resulting in greater SNR. The improved phase difference estimates may also be utilized to detect, locate and/or reject signals originating from the "desired" source location, or locations other than a "desired" source.

FIG. 1 illustrates a system that includes a plurality of audio signal sources 102 and an adaptive phase discovery system 104, including a computer processor 108 and a memory 110. The adaptive phase discovery system 104 may receive input signals from the plurality of audio signal sources 102, process the signals, and output an estimated phase difference of the input signals received from the plurality of audio signal sources for a range of frequency sub-bands. The audio signal sources 102 may be microphones, an incoming communication system channel, a pre-processing system, or another signal input device. Although only two audio signal sources 102 are shown in FIG. 1, the system may include more than two sources. In some systems, the sources 102 may be evenly spaced apart. In other systems the sources 102 may be positioned relative to each other with uneven spacing between the plurality of audio signal sources 102. The audio signal sources 102 may be referred to as the microphones, channels or detectors, for example. In relation to a microphone or detector, a sound source may be referred to as a voice, a speaker or an emitter, for example.

The adaptive phase discovery system 104 may include the computer processor 108 and the memory device 110. The computer processor 108 may be implemented as a central processing unit (CPU), microprocessor, microcontroller, application specific integrated circuit (ASIC), or a combination of other types of circuits. In one implementation, the computer processor may be a digital signal processor ("DSP") including a specialized microprocessor with an architecture optimized for the fast operational needs of digital signal processing. Additionally, in some implementations, the digital signal processor may be designed and customized for a specific application, such as an audio system of a vehicle or a signal processing chip of a mobile communication device (e.g., a phone or tablet computer). The memory device 110 may include a magnetic disc, an optical disc, RAM, ROM, DRAM, SRAM, Flash and/or any other type of computer memory. The memory device 110 may be communicatively coupled with the computer processor 108 so that the computer processor 108 can access data stored on the memory device 110, write data to the memory device 110, and execute programs and modules stored on the memory device 110.

The memory device 110 may include one or more data storage areas 112 and one or more programs. The data and programs may be accessible to the computer processor 108 so that the computer processor 108 is particularly programmed to implement the adaptive phase discovery functionality of the system. The programs may include one or more modules executable by the computer processor 108 to perform the desired function. For example, the program modules may include a sub-band processing module 114, a signal power determination module 116, a background noise power estimation module 118, a phase differences calculation module 120, low frequency phase analysis module 122, a high frequency phase analysis module 124, a low frequency phase estimate update module 126 and a high frequency phase estimate update module 128. Also shown in FIG. 1 are an off-axis logic and signal mixing module 130 and a resynthesis module 132 which may be included in the memory device 110 and/or may be stored in one or more separate locations. The memory device 110 may also store additional programs, modules, or other data to provide additional programming to allow the computer processor 108 to perform the functionality of the adaptive phase discovery system 104. The described modules and programs may be parts of a single program, separate programs, or distributed across several memories and processors. Furthermore, the programs and modules, or any portion of the programs and modules, may instead be implemented in hardware.

Figure 2:
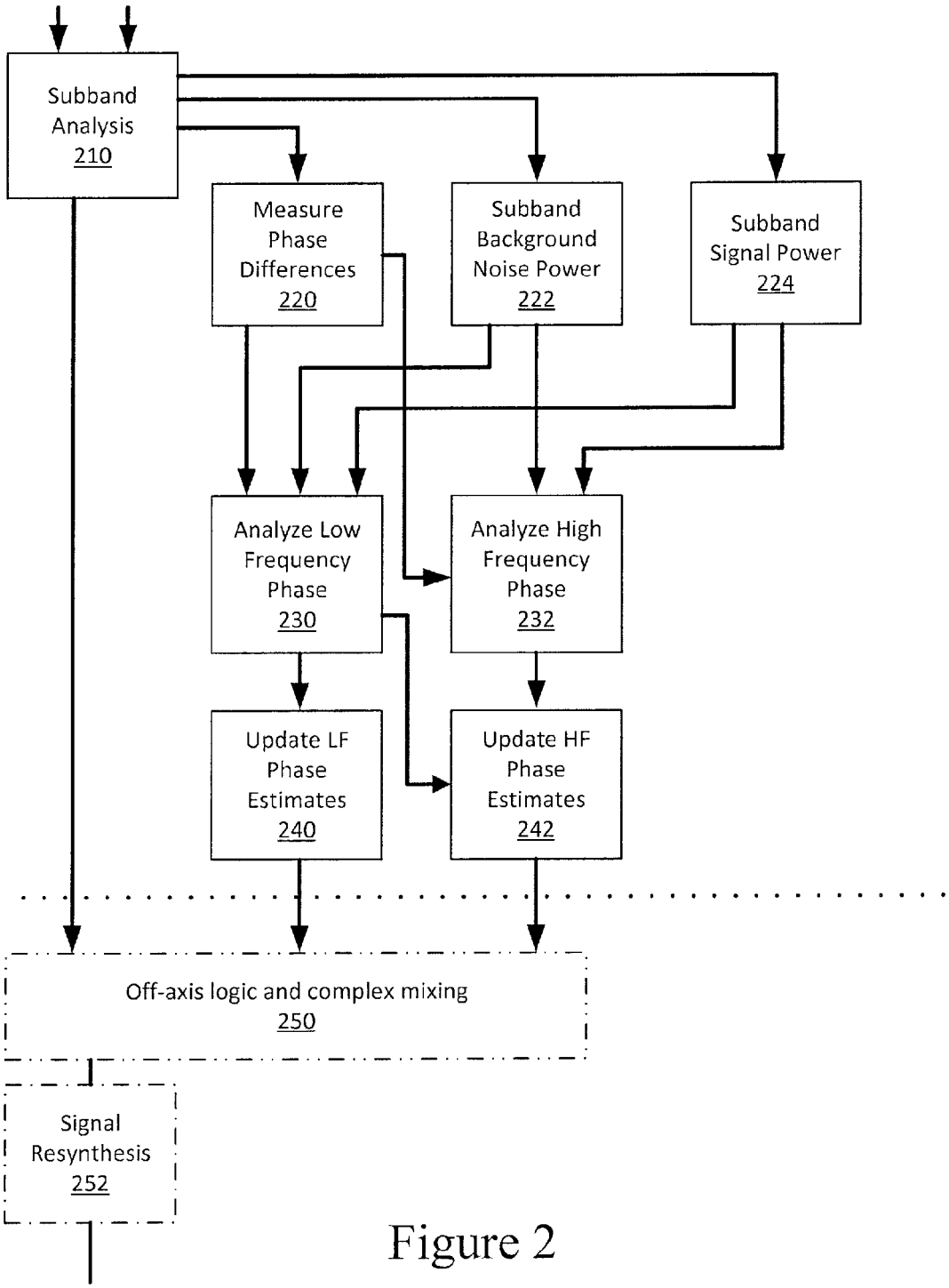
FIG. 2 is a flow diagram of steps for determining phase differences in two or more signals.

FIG. 2 is a flow chart illustrating functions performed by the adaptive phase discovery system of FIG. 1. The functions represented in FIG. 2 may be performed by the computer processor 108 by accessing data from data storage 112 of FIG. 1 and by executing one or more of the modules 114-132 of FIG. 1. For example, the processor 108 may execute the sub-band processing module 114 at step 210, the signal power determination module 116 at step 224, the background noise power estimation module 118 at step 222, the phase differences determination module 120 at step 220, the low frequency phase analysis module 122 at step 230, the high frequency phase analysis module 124 at step 232, the low frequency phase estimate update 126 at step 240 and the high frequency phase estimate update 128 at step 242. Furthermore, the processor 108 may execute off-axis rejection, complex mixing and/or signal resynthesis modules 130 and 132 at steps 250 and 252. In this regard, the output of the sub-band analysis step 210, the low frequency phase estimate update step 240 and/or the high frequency phase estimate update step 242 may provide improved phase difference information to the off-axis logic and complex mixing step 250. Any of the modules or steps described herein may be combined or divided into a smaller or larger number of steps or modules than what is shown in FIGS. 1 and 2.

In FIG. 2, the adaptive phase discovery system 104 may begin its signal processing sequence with sub-band analysis at step 210. The system may receive the plurality of audio signals from the audio sources 102, for example, signals that may include speech and/or noise content. In step 210, each audio signal may be converted from a time domain signal to a frequency domain signal. For example, an interval or frame of each audio signal, such as a 32 millisecond (ms) interval may be converted to a frame of audio in the frequency domain. At step 210, for each input signal, a sub-band filter may process the input signal to extract frequency information. The sub-band filtering step 210 may be accomplished by various methods, such as a Fast Fourier Transform ("FFT"), critical filter bank, octave filter bank, or one-third octave filter bank. The sub-band analysis at step 210 may include a frequency based transform, such as by a Fast Fourier Transform. Alternatively, the sub-band analysis at step 210 for each input signal may include time based filterbanks. Each time based filterbank may be composed of a bank of overlapping bandpass filters, where the center frequencies have non-linear spacing such as octave, 3rd octave, bark, mel, or other spacing techniques. The bands may be narrower at lower frequencies and wider at higher frequencies. In instances when a time based filter bank is utilized at step 210, at step 220, phase differences between two signals may be determined as a time shift between the two signals. In the filterbank used at step 210, the lowest and highest filters may be shelving filters so that all the components may be resynthesized at step 252 to essentially recreate the same input signals. A frequency based transform may use essentially the same filter shapes applied after transformation of the signal to create the same non-linear spacing or sub-bands. The frequency based transform may also use a windowed add or overlap analysis.

In some systems, each of the audio signals from the two or more microphones 102 may be converted into a frequency domain representation in step 210 where magnitude and phase information may be associated with each discrete frequency range or frequency bin of each signal. For example, for each received time domain signal, the sub-band analysis step 210 may apply a Fast Fourier Transform (FFT) process, where each resulting frequency bin (i) may be represented by a complex variable having a real ($Re_i$) component and an imaginary ($Im_i$) component.

At step 224, A signal magnitude may be estimated for each frequency bin (i) by deriving a magnitude of the hypotenuse of the real and imaginary components, as described in equation 1:

$$M_i=(Re_i^2+Im_i^2)^{1/2} \quad \text{(Equation 1)}$$

To reduce complexity, the magnitude may be approximated by a weighted sum of the absolute values, as described in Equation 2:

$$M_i=w\times(|Re_i|+|Im_i|) \quad \text{(Equation 2)}$$

The phase ($\phi_i$) at each frequency bin may comprise the arctan of the complex components or an approximation of the arctan trigonometric function of Equation 3:

$$\phi_i=\tan^{-1}(Im_i/Re_i) \quad \text{(Equation 3)}$$

At step 220, the phase differences determination module 120 may receive the phase information output from step 210 and may determine a phase difference ($\delta\phi_i$) between complex components of a first audio signal L and a second audio signal R at each frequency (i) based on Equation 4:

$$\delta\phi_i=L\phi_i-R\phi_i \quad \text{(Equation 4)}$$

In order to determine when an audio signal may be present, the adaptive phase discovery system 104 may determine a signal to noise ratio (SNR) for one or more frequency bins (i) or frequency sub-bands.

In step 224, the derived magnitudes $M_i$ may be compared to noise estimates which may be determined for each frequency bin (i) in step 222. A signal to noise ratio may be estimated for each signal at each frequency bin.

In some systems, the sub-band analysis at step 210 may output a set of sub-band signals for each input signal where each set is represented as $X_{n,k}$, referring to the kth sub-band at time frame n.

At step 224, the signal power determination module 116 may receive one or more of the sub-band signals from step 210 and may determine a sub-band average signal power of each sub-band. The sub-band average signal power output from step 224 may be represented as $|\overline{X}_{n,k}|^2$. In one implementation, for each sub-band, the sub-band average signal power may be calculated by a first order Infinite Impulse Response ("IIR") filter according to the following equation 5:

$$|\overline{X}_{n,k}|^2=\beta|X_{n-1,k}|^2+(1-\beta)|X_{n,k}|^2 \quad \text{(Equation 5)}$$

Here, $|X_{n,k}|^2$ is the signal power of kth sub-band at time n, and $\beta$ is a coefficient in the range between zero and one. In one implementation, the coefficient $\beta$ is a fixed value. For example, the coefficient $\beta$ may be set at a fixed level of 0.9, which results in a relatively high amount of smoothing. Other higher or lower fixed values are also possible depending on the desired amount of smoothing. In other implementations, the coefficient $\beta$ may be a variable value. For example, the system may decrease the value of the coefficient $\beta$ during times when a lower amount of smoothing is desired, and increase the value of the coefficient $\beta$ during times when a higher amount of smoothing is desired.

At step 224, the sub-band signal magnitude $|X_{n,k}|$ or the signal power of the kth sub-band $|X_{n,k}|^2$ at time n, may be smoothed, filtered, and/or averaged. The amount of smoothing may be constant or variable. In one implementation, the signal is smoothed in time. In other implementations, frequency smoothing may be used. For example, the system may include some frequency smoothing when the sub-band filters have some frequency overlap. The amount of smoothing may be variable in order to exclude long stretches of silence into the average or for other reasons. The power analysis processing at step 224 may output a smoothed magnitude or power of each input signal in each sub-band.

At step 222, the system may receive the sub-band signals from sub-band processing module 114 and may estimate a sub-band background noise level or sub-band background noise power for each sub-band. The sub-band background noise level may be represented as $B_{n,k}$. In one implementation, the background noise level is calculated using the background noise estimation techniques disclosed in U.S. Pat. No. 7,844,453, which is incorporated herein by reference, except that in the event of any inconsistent disclosure or definition from the present specification, the disclosure or definition herein shall be deemed to prevail. In other implementations, alternative background noise estimation techniques may be used, such as a noise power estimation technique based on minimum statistics. The background noise level calculated at step 222 may be smoothed and averaged in time or frequency. The output of the background noise estimation at step 222 may be the magnitude or power of the estimated noise for each sub-band.

Output from the signal power determination module 116 and the background noise power estimation module 118 may be communicated to the low frequency phase analysis module 122 and the high frequency phase analysis module 124 at steps 230 and 232 respectively.

The low frequency phase analysis step 230 may include receiving the sub-band average signal power $\overline{X}_{n,k}$ and sub-band background noise power $B_{n,k}$ as inputs. In this example, the system uses the sub-band average signal power $\overline{X}_{n,k}$ and sub-band background noise power $B_{n,k}$ to calculate a signal-to-noise ratio in each sub-band. The signal-to-noise ratio may vary across the frequency range. In some frequency sub-bands a high signal-to-noise ratio may result while in other frequency sub-bands the signal-to-noise ratio may be lower or even negative.

In instances when a high SNR is measured in sub-bands of a lower portion of the spectrum, the system may determine that an audio signal is present. In instances when an audio signal may be present, the system may utilize low frequency phase differences to make an initial estimate of phase differences ($\Delta\Phi$) in the higher frequencies of the signals. As described with respect to FIGS. 3 and 4, the estimate may be based on a relationship between the difference in path lengths of two audio signals $d_1$ and $d_2$, and a set of phase differences which vary linearly over frequency for the given difference in path lengths, shown in Equation 6.

$$\Delta\Phi=2\pi*(d_2-d_1)/\omega \quad \text{(Equation 6)}$$

Figure 3:
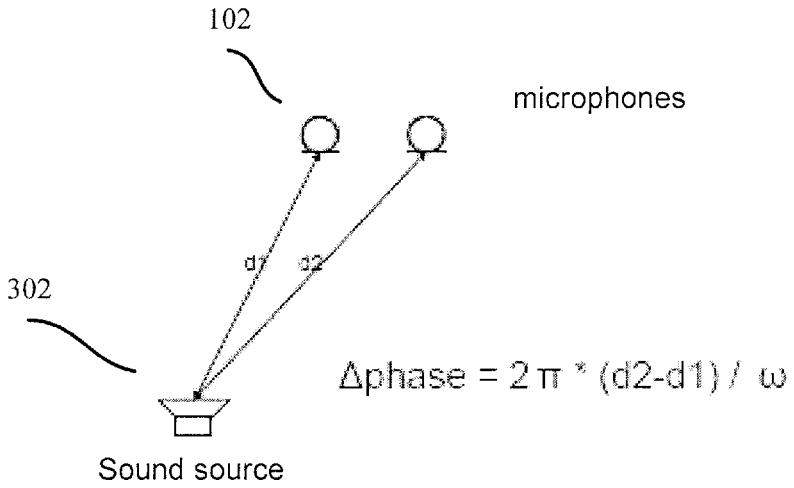
FIG. 3 is diagram of two path lengths including a first path length from a sound source to a first microphone and a second path length from the sound source to a second microphone detector.
Figure 3:
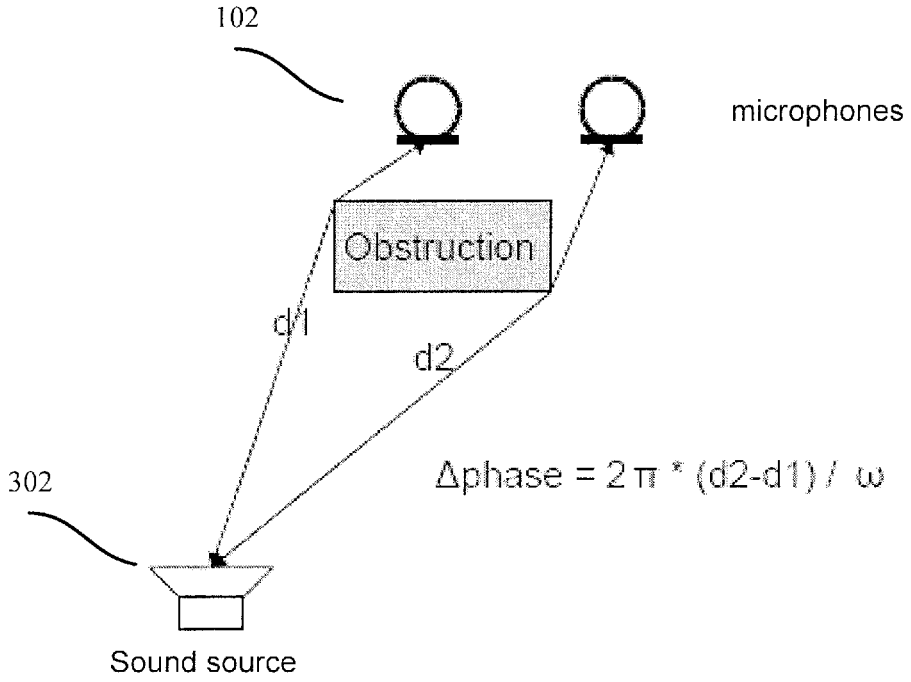

FIG. 3 depicts an exemplary arrangement of a sound source 300 and two microphones 102 with paths $d_1$ and $d_2$ from the sound source 300 ("emitter") to each of the microphones 102 ("detectors"). The sound source 300 is first shown in a free field with two microphone detectors 102. Since the distance from the source 300 to each microphone is different, the phase of the signal observed at the farther microphone will be shifted behind that observed at the closer microphone due to the added time-of-flight of the sound in air. When reflective surfaces and obstructive objects are placed into the environment the signals observed at the microphones are subject to effects such as reflection, absorption and diffraction. In a physical environment, such as a car cabin or a room with obstructions, at lower frequencies, the effects of wave diffraction may dominate, while at higher audio frequencies, waves may be subjected, more often, to reflection effects. FIG. 3 show that diffracted signals in the obstructed paths $d_1$ and $d_2$ may yield similar path length differences as shown in an unobstructed environment and therefor may cause similar phase differences in the two signals. Exact placement of microphones or knowledge of the distance between microphones may not be known. In systems utilizing more than two microphones, microphones may be placed at equal distances in a microphone array; however, this is not necessary and other suitable systems may use unequal distances between microphones. Moreover, although examples of a car cabin and room are provided, the system is not limited to a specific physical environment and any suitable physical environment may be utilized.

Figure 4:
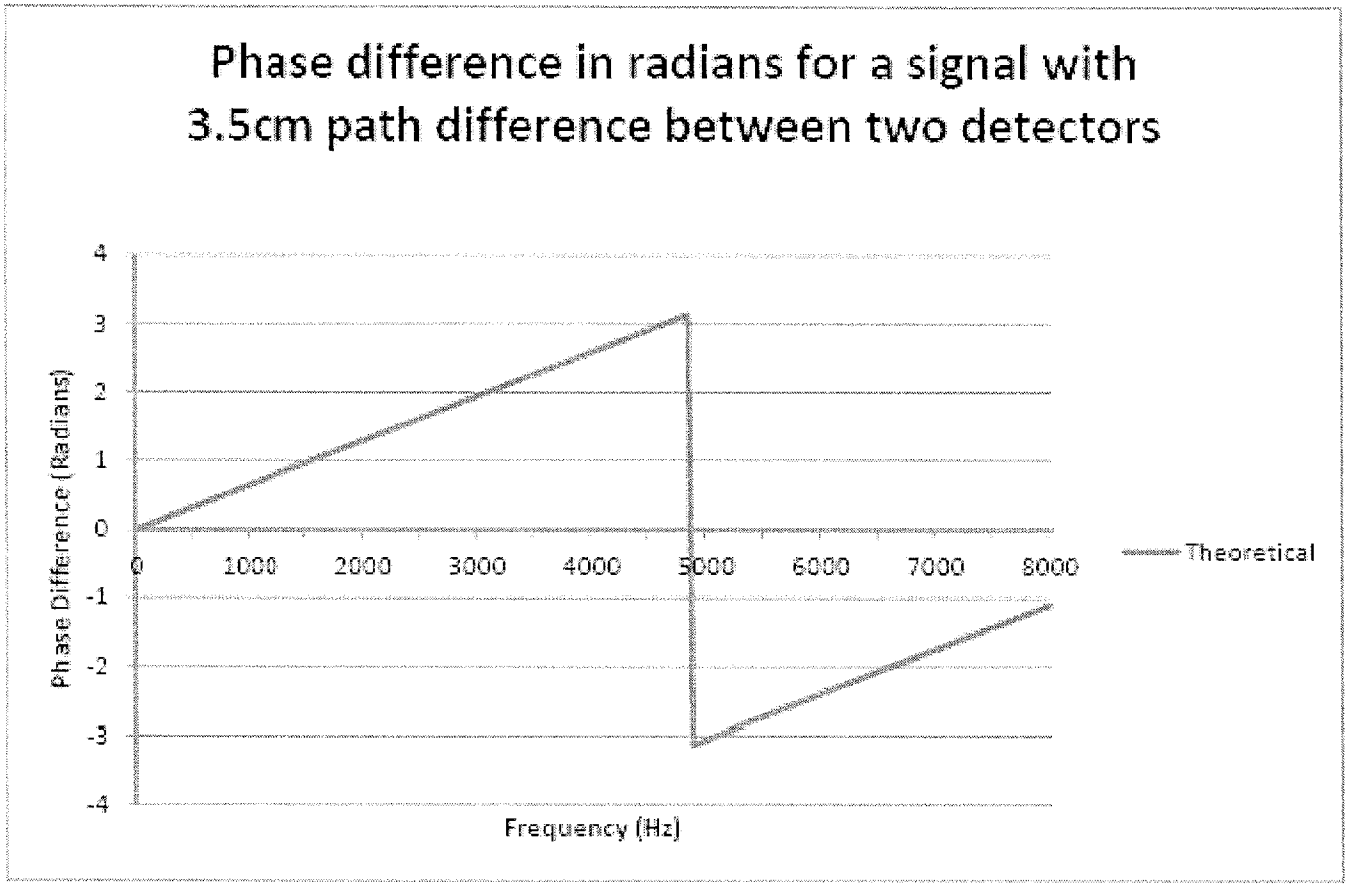
FIG. 4 is a plot of theoretical phase differences limited to a range of positive pi radians to negative pi radians, over frequency, for a given path length difference of two detected audio signals.

FIG. 4 is a line plot of theoretical phase differences at two microphone detectors 102 as a function of frequency where the path length difference between $d_1$ and $d_2$ is 3.5 cm. The chart exhibits a sloped line with a range from 0 to positive pi ($+\pi$) radians and from 0 to negative pi ($-\pi$) radians. Although the phase difference continues to increase as frequency increases and wave lengths decrease, when the phase difference reaches one half wave length ($+\pi$ radians), the phase difference plot is flipped to depict the phase differences as negative one half wave length where it continues to increase from $-\pi$ radians to zero. For the path length difference of 3.5 cm, the phase flips or wraps from $+\pi$ radians to $-\pi$ radians, at approximately 4850 Hz.

Figure 5:
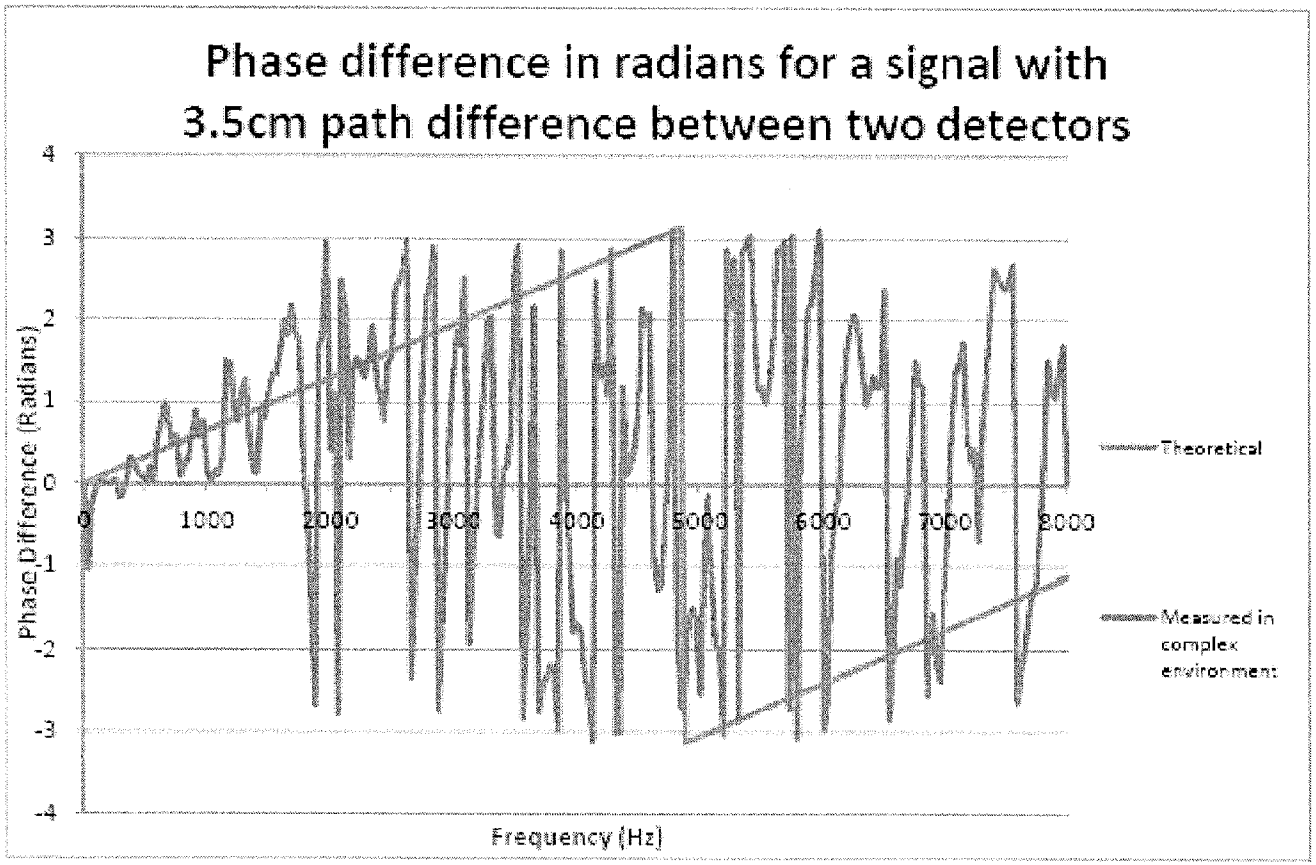
FIG. 5 is the theoretical phase difference plot of FIG. 4 overlaid with measured phase differences of two acoustic signals, over frequency.

FIG. 5 includes a line plot of the theoretical phase differences as shown in FIG. 4 and a non-linear plot of measured phase differences at each frequency, overlaid onto the theoretical straight line plot. The measured phase differences are subject to effects such as reflection, absorption and diffraction, for example, due to obstructions in a car cabin or in another physical environment. The measured phase differences at lower frequencies, for example, below about 1.5 kHz for the 3.5 cm path difference, are similar or close to the theoretical phase differences. But at higher frequencies, the similarity breaks down. It may be assumed that the measured phase differences at low frequencies will be close to the theoretical differences in a free field, due to diffraction effects dominating at lower frequencies when a path from an emitter to a detector is obstructed, or partially obstructed.

At step 230 of FIG. 2, in instances when the SNR at low frequencies, for example, below 1.5 KHz, indicates that an audio signal is present, it may be assumed that any signal present, as indicated by the SNR, at higher frequencies is likely to be from the same source. Thus when the phase differences and SNR at the low frequencies indicate that the signals detected at the microphones come from such a desired source, the current instantaneous phase differences at higher frequencies may be used as an improved estimate of the phase differences that will be observed in signals coming from the same desired source. Phase difference estimates for the higher frequencies can then be updated to more closely match the current measured phase differences for example by taking a weighted average of the previous estimate and the currently observed value. As this process may be repeated over time the estimates of the phase differences at the higher frequencies will more and more closely match the phase differences produced by sound from the desired source.

At step 240, the low frequency phase differences information may be communicated from step 220 to the low frequency phase analysis module 122. At step 240 the low frequency phase difference information may be processed and the current low frequency phase difference estimates may be updated for each frequency bin over time. In this regard, for each low frequency bin, one or more prior estimated phase differences may be filtered with the current phase difference to determine and/or update the current estimated phase difference for each low frequency bin. In some systems, the first iteration of the process may utilize initial estimates of the phase differences for filtering. For example, the initial estimate may be equal to a theoretical phase difference in a free field. At step 240 the updated current low frequency phase difference data may be sent to one or more applications. For example, the current phase difference data may utilized for implementing off-axis rejection and/or for complex signal mixing by the module 130 in step 250.

At step 232, the high frequency phase analysis module 124 may receive instantaneous phase differences from step 220 and signal to noise information from steps 222 and 224 and may determine when a signal is present at higher frequencies.

At step 242, the determined high frequency phase difference information, for example, for frequencies above 1.5 kHz which may correlate to strong SNR found in the low frequency signal components, may be communicated to the high frequency phase analysis module 124. At step 242, the high frequency phase analysis module 124 may receive the tracked high frequency phase differences. For audio time frames where the high frequency phase differences may be correlated to strong signal content in the low frequencies, each estimated high frequency phase difference may be filtered over time based on one or more prior phase difference values to estimate the high frequency phase differences which are due to sound from the source reaching the microphones via various paths. At step 242 the updated high frequency phase difference data for the current audio frame may be sent to one or more applications. For example, the current high frequency phase difference data may utilized in off-axis rejection processes or in a complex signal mixing by the module 130 in step 250.

In steps 240 and 242, low frequency and/or high frequency phase differences of a current audio frame may be updated across the frequency spectrum and the process steps 210 through step 242 may be repeated for the next audio frame. In this manner, phase differences produced by audio signals received via a plurality of microphones may be determined without prior calibration and where precise modeling of the physical environment or knowledge of microphone placement is unknown.

In step 250, the off-axis logic and signal mixing module 130 may receive the phase and magnitude values for each frequency band for the first signal L and the second signal R. In step 250, the first and second signals may be mixed on a frame-by-frame basis by rotating one signal in phase with the other signal. In some systems the lower amplitude signal (or the signal with lower signal to noise ratio) may be rotated in phase with the higher amplitude signal (or the signal with a higher signal to noise ratio). Rotation may occur independently at each frequency or frequency bin. For each frame, and frequency bin, the lower amplitude signal may be rotated in line with the higher amplitude signal. In some systems, the mixing of signals may be performed in accordance with the techniques disclosed in U.S. Pat. No. 8,121,311, filed on Nov. 4, 2008 and which is incorporated herein by reference, except that in the event of any inconsistent disclosure or definition from the present specification, the disclosure or definition herein shall be deemed to prevail. In other implementations, alternative mixing techniques may be used.

In one system, detecting strong signal content in the high and low frequency ranges, for example, above and below the exemplary 1.5 kHz, may indicate that the same signal content is present in the high and low frequency ranges. In this situation, tracking and filtering of the high frequency phase differences in strong signals may enable the signals to be combined constructively. For example, if a strong signal is found at 1 kHz that has 0 phase difference, it may be determined that a strong signal at 4 kHz is related even if it is 180 degrees out of phase. In this case, the two captured signals at 4 kHz may be combined by rotating one to be in phase with the other before combining them. At another iteration of the process, in instances when a significant signal level is not found at 1 kHz but a strong signal is found at 4 kHz that has 0 phase difference, this may indicate that noise or interference is present and that the signal should be suppressed. Suppression may be handled by rotating one signal 180 degrees out a phase with the other and adding them together. Similar results may be achieved using sub-band filtering techniques and time delay elements.

Also at step 250, off-axis rejection may be implemented. An exemplary off-axis rejection system may include voice recognition processing in a car cabin comprising two or more microphones 102 which may receive voice commands from a driver. Voice recognition may be impeded by receiving additional audio other than the driver's spoken command. For example, conversations between the passengers may make identifying a desired command associated with the driver's spoken command difficult. In order to enhance audio associated with the driver's spoken command and suppress the additional audio, conceptually a region of interest relative to the two microphones 102 may be associated with the driver and an axis may be determined from the region of interest to the two microphones 102. The axis may be associated with a slope of a phase difference between audio received at two spaced apart microphones 102. Audio that is determined to originate from a source off-axis to the region of interest may be suppressed at step 250. By suppressing the off-axis audio and/or enhancing the on axis audio through mixing phase adjusted signals in accordance with the low frequency phase difference estimates and/or high frequency phase difference estimates determined in steps 240 and 242, an improved audio signal may be provided to the voice recognition system, improving the chances of correctly identifying a spoken command. The off-axis suppression process may include determining instantaneous phase differences between the first and second audio signals for each frequency bin as described above with respect to step 220. A direction error may be determined between the instantaneous phase differences and the slope of the phase differences determined in steps 240 and 242. The first and second audio signals may be processed based on the calculated direction error to suppress off-axis audio relative to the positions of the first and second microphones and the region of interest. Additional off-axis rejection techniques may be utilized as disclosed in U.S. patent application Ser. No. 13/194,120, which was filed on Jul. 29, 2011 and which is incorporated herein by reference, except that in the event of any inconsistent disclosure or definition from the present specification, the disclosure or definition herein shall be deemed to prevail.

Further to this, the system may be refined by varying the speed of adaptation of the phase difference estimates by beginning with quick adaption when little or no previous signal has been measured, and slowing as more iteration takes place. In this manner, quickly adapting may enable finding a desired phase difference and slower adaptation over time may be utilized to "lock on" to the desired phase differences once they have been found, increasing robustness to competing undesired signals. The speed of adaptation can be based on the level of SNR measured to ensure that strong clear signals can be quickly detected.

As a by-product of measuring the amount of adaptation that has taken place across the frequency spectrum, a level of confidence in the current phase difference estimate may be given at any frequency. This may be used by subsequent processing steps and may form another output of the algorithm. For example, the off-axis rejection system may use this level of confidence to know the degree to which the signal can be safely rejected at any given frequency Each of the processes described herein may be encoded in a computer-readable storage medium (e.g., a computer memory), programmed within a device (e.g., one or more circuits or processors), or may be processed by a controller or a computer. If the processes are performed by software, the software may reside in a local or distributed memory resident to or interfaced to a storage device, a communication interface, or non-volatile or volatile memory in communication with a transmitter. The memory may include an ordered listing of executable instructions for implementing logic. Logic or any system element described may be implemented through optic circuitry, digital circuitry, through source code, through analog circuitry, or through an analog source, such as through an electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable storage medium," "machine-readable medium," "propagated-signal" medium, and/or "signal-bearing medium" may comprise a medium (e.g., a non-transitory medium) that stores, communicates, propagates, or transports software or data for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection having one or more wires, a portable magnetic or optical disk, a volatile memory, such as a Random Access Memory (RAM), a Read-Only Memory (ROM), an Erasable Programmable Read-Only Memory (EPROM or Flash memory), or an optical fiber. A machine-readable medium may also include a tangible medium, as the software may be electronically stored as an image or in another format (e.g., through an optical scan), then compiled, and/or interpreted or otherwise processed. The processed medium may then be stored in a computer and/or machine memory.

While various embodiments, features, and benefits of the present system have been described, it will be apparent to those of ordinary skill in the art that many more embodiments, features, and benefits are possible within the scope of the disclosure. For example, other alternate systems may include any combinations of structure and functions described above or shown in the figures.

We claim:

1. A method for determining phase difference, the method comprising:

determining a phase of a first signal and a phase of a second signal;

determining an instantaneous phase difference between said first signal and said second signal based on said phase of said first signal and said phase of said second signal;

filtering said instantaneous phase difference over time for frequencies below a specified frequency threshold;

estimating a phase difference between said first signal and said second signal at one or more frequencies above said specified frequency threshold, based on said filtered phase difference of frequencies below said specified frequency threshold; and detecting presence of an audio signal based on signal to noise ratio, signal level or signal power level at one or more frequencies below said specified frequency threshold and including said audio signal in said filtering said instantaneous phase difference over time for frequencies below said specified frequency threshold.

2. The method of claim 1, further comprising filtering said estimated phase differences over time.

3. The method of claim 1, wherein said specified frequency threshold is based on one or more of:

acoustic wave characteristics;

microphone placement characteristics; and microphone characteristics.

4. The method of claim 1, further comprising determining said signal to noise ratio at one or more frequencies by comparing a signal level or signal power level to an estimate of background noise at said one or more frequencies.

5. The method of claim 1, wherein said estimating said phase difference between said first signal and said second signal at one or more frequencies above said specified frequency threshold, is performed in instances when an audio signal is detected at one or more frequencies below said specified frequency threshold and at one or more frequencies above said frequency threshold.

6. The method of claim 1, wherein said phase difference between said first signal and said second signal at one or more frequencies above said specified frequency threshold is correlated to audio signal content found in one or more frequencies below said specified frequency threshold and to strong signal content found in one or more frequencies above said specified frequency threshold.

7. The method of claim 1, wherein said frequencies comprise one or more frequency sub-bands.

8. The method of claim 1, further comprising summing said first signal and said second signal by rotating phases of said second signal at one or more frequencies according to said filtered phase difference for frequencies below said specified frequency threshold and for said filtered phase difference for frequencies above said specified frequency threshold.

9. The method of claim 1, further comprising rejecting off-axis signal components based on said filtered phase difference for frequencies below said specified frequency threshold or said filtered phase difference for frequencies above said specified frequency threshold.

10. The method of claim 1, further comprising generating a set of sub-bands of said first signal and of said second signal through a sub-band filter or a Fast Fourier Transform to determine said one or more frequencies.

11. The method of claim 10, further comprising generating said set of sub-bands of said first signal and said second signal according to a critical, octave, mel or bark band spacing technique.

12. The method of claim 1, wherein the steps of filtering the instantaneous phase difference and estimating the phase difference are performed by one or more computer processors that execute filtering and estimation instructions stored in a computer memory.

13. A system for determining phase difference, said system comprising one or more processors or circuits, said one or more processors or circuits being operable to:

determine a phase of a first signal and a phase of a second signal;

determine an instantaneous phase difference between said first signal and said second signal based on said phase of said first signal and said phase of said second signal;

filter said instantaneous phase difference over time for frequencies below a specified frequency threshold;

estimate a phase difference between said first signal and said second signal at one or more frequencies above said specified frequency threshold, based on said filtered phase difference of frequencies below said specified frequency threshold; and detect presence of an audio signal based on signal to noise ratio, signal level or signal power level at one or more frequencies below said specified frequency threshold and include said audio signal in said filtering said instantaneous phase difference over time for frequencies below said specified frequency threshold.

14. The system of claim 13, wherein said one or more processors or circuits are operable to filter said estimated phase differences over time.

15. The system of claim 13, wherein said specified frequency threshold is based on one or more of:

acoustic wave characteristics;

microphone placement; and microphone characteristics.

16. The system of claim 13, wherein said one or more processors or circuits are operable to determine said signal to noise ratio at one or more frequencies by comparing a signal level or signal power level to an estimate of background noise at said one or more frequencies.

17. The system of claim 13, wherein said estimating said phase difference between said first signal and said second signal at one or more frequencies above said specified frequency threshold, is performed in instances when an audio signal is detected at one or more frequencies below said specified frequency threshold and at one or more frequencies above said frequency threshold.

18. The system of claim 13, wherein said phase difference between said first signal and said second signal at one or more frequencies above said specified frequency threshold is correlated to audio signal content found in one or more frequencies below said specified frequency threshold and to strong signal content found in one or more frequencies above said specified frequency threshold.

19. The system of claim 13, wherein said frequencies comprise one or more frequency sub-bands.

20. The system of claim 13, wherein said one or more processors or circuits are operable to sum said first signal and said second signal by rotating phases of said second signal at one or more frequencies according to said filtered phase difference for frequencies below said specified frequency threshold and for said filtered phase difference for frequencies above said specified frequency threshold.

21. The system of claim 13, wherein said one or more processors or circuits are operable to reject off-axis signal components based on said filtered phase difference for frequencies below said specified frequency threshold or said filtered phase difference for frequencies above said specified frequency threshold.

22. The system of claim 13, wherein said one or more processors or circuits are operable to generate a set of sub-bands of said first signal and of said second signal through a sub-band filter or a Fast Fourier Transform to determine said one or more frequencies.

23. The system of claim 22, wherein said one or more processors or circuits are operable to generate said set of sub-bands of said first signal and said second signal according to a critical, octave, mel or bark band spacing technique.

24. The system of claim 13, wherein said steps of filtering said instantaneous phase difference and estimating said phase difference are performed by one or more computer processors that execute filtering and estimation instructions stored in a computer memory.

25. A system for determining phase difference, said system comprising one or more processors or circuits, said one or more processors or circuits being operable to:

receive a first audio signal via a first microphone and a second audio signal via a second microphone;

for a frame of said first audio signal and a corresponding frame of said second audio signal:

transform said first audio signal and said second audio signal into a first frequency domain signal and a second frequency domain signal and generate a plurality of frequency sub-bands for each of said first frequency domain signal and said second frequency domain signal;

determine a phase of said first frequency domain signal and a phase of said second frequency domain signal at each of one or more of said plurality of frequency sub-bands;

determine an instantaneous phase difference between said first frequency domain signal and said second frequency domain signal at each of said one or more of said plurality of frequency sub-bands;

filter said instantaneous phase differences over time for frequencies below a specified frequency threshold;

estimate phase differences between said first frequency domain signal and said second frequency domain signal at one or more of said plurality of frequency sub-bands above said specified frequency threshold, based on said filtered phase differences at one or more of said plurality of frequency sub-bands below said specified frequency threshold;

filter said estimated phase differences over time; and detect presence of an audio signal based on signal to noise ratio, signal level or signal power level at one or more frequencies below said specified frequency threshold and include said audio signal in said filtering said instantaneous phase difference over time for frequencies below said specified frequency threshold.

* * * * *